US008672160B2

(12) United States Patent
Escobar et al.

(10) Patent No.: US 8,672,160 B2
(45) Date of Patent: Mar. 18, 2014

(54) COMPOSITE INTERLOCKING STOPPER AND METHOD OF MANUFACTURE

(75) Inventors: Miguel F. Escobar, Mexico City (MX); Ricardo Escobar, Mexico City (MX)

(73) Assignee: Tapones Escobar, S.A. (MX)

( * ) Notice: Subject to any disclaimer, the term of this patent is extended or adjusted under 35 U.S.C. 154(b) by 103 days.

(21) Appl. No.: 12/842,091

(22) Filed: Jul. 23, 2010

(65) Prior Publication Data

US 2011/0017698 A1 Jan. 27, 2011

Related U.S. Application Data

(60) Provisional application No. 61/228,324, filed on Jul. 24, 2009.

(51) Int. Cl.
*B65D 39/00* (2006.01)
*B65D 39/16* (2006.01)

(52) U.S. Cl.
USPC ..... 215/364; 215/355

(58) Field of Classification Search
USPC ..... 215/355, 365, 296, 297; 264/274
See application file for complete search history.

(56) References Cited

U.S. PATENT DOCUMENTS

| | | | | |
|---|---|---|---|---|
| 2,046,224 | A * | 6/1936 | Vanderhoof | 215/296 |
| 2,095,272 | A * | 10/1937 | Vanderhoof | 215/296 |
| 4,483,451 | A * | 11/1984 | Gorski | 215/296 |
| 4,889,251 | A | 12/1989 | Hojnoski | |
| 5,636,757 | A * | 6/1997 | Porvaznik | 215/364 |
| 6,168,036 | B1 * | 1/2001 | Teng | 215/296 |
| 2002/0153342 | A1 * | 10/2002 | Fragola | 215/364 |
| 2004/0112856 | A1 * | 6/2004 | Hwang et al. | 215/361 |
| 2004/0169001 | A1 * | 9/2004 | Leendersten et al. | 215/355 |
| 2004/0232102 | A1 * | 11/2004 | Gardner et al. | 215/299 |
| 2004/0238479 | A1 * | 12/2004 | Caswell et al. | 215/364 |
| 2006/0231520 | A1 * | 10/2006 | Van Cromvoirt | 215/355 |
| 2007/0272650 | A1 * | 11/2007 | Kishi et al. | 215/364 |
| 2008/0116165 | A1 * | 5/2008 | Lin | 215/294 |

FOREIGN PATENT DOCUMENTS

| | | | |
|---|---|---|---|
| DE | 202004016818 | U1 | 4/2005 |
| DE | 102004034709 | B3 | 2/2006 |
| EP | WO2010078417 | | 7/2010 |
| EP | 2277791 | | 1/2011 |
| FR | 1221748 | A | 6/1960 |
| GB | 2405144 | A | 2/2005 |
| JP | 2001048204 | A | 2/2001 |
| WO | W09901354 | A1 | 1/1999 |
| WO | W02004024585 | A1 | 3/2004 |

OTHER PUBLICATIONS

European Search Report for Application No. 10170616 dated Sep. 2, 2010, 6 pages.
European Search Report for Application No. 10189621.5 dated Feb. 9, 2011, 9 pages.
Notice of Allowance for EP Application No. 101707616.6 dated Dec. 23, 2011, 4 pages.

* cited by examiner

*Primary Examiner* — Mickey Yu
*Assistant Examiner* — Niki Eloshway
(74) *Attorney, Agent, or Firm* — Cantor Colburn LLP

(57) ABSTRACT

A composite synthetic cork is provided, wherein the synthetic cork is operatively coupled with a cap via an interlocking contour. In an exemplary embodiment, the interlocking contour(s) is molded on an otherwise flat bottom portion of the cap. In other exemplary embodiments, the cap and the cork are assembled via co-injection molding.

7 Claims, 4 Drawing Sheets

COMPOSITE INTERLOCKING STOPPER AND METHOD OF MANUFACTURE

CROSS REFERENCE TO RELATED APPLICATION

The present application claims priority to U.S. Provisional Patent Application Ser. No. 61/228,324 filed Jul. 24, 2009, the entire contents of which are specifically incorporated by reference herein.

BACKGROUND

The present disclosure relates to container closures including a cork material interlocked with a handle or cap (hereinafter referred to as a cap).

Producers of liquid consumable products, such as wine, liquor and other products, that are sold in bottles or other containers that are traditionally closed and sealed with cork stoppers have long been concerned about the reliability and structural integrity of the cork and cap, particularly along the interface of the two. Traditional models use glue to bond the cork to the cap. However, breakage of the bond remains a significant concern in the industry.

Accordingly, there is a need in the industry for a more reliable bond between the cork and the cap.

SUMMARY

The present stopper comprises a cork portion that is bonded to a cap portion via an interlocking interface. In an exemplary embodiment, the cork material is a synthetic cork material. In another exemplary embodiment, the cork material is injection molded over a portion of the cap, which portion includes surface contouring that provides more surface area for the cork to cap bond.

In another exemplary embodiment, a first cap portion contour creates a mechanical interlock that resists relative movement of the cork and the cap in a first direction. In another exemplary embodiment, a second cap portion contour creates a mechanical interlock that resists relative movement of the cork and the cap in a second direction.

In other exemplary embodiments, a first cap portion contour creates a mechanical interlock that resists separation of the cork and the cap. In other exemplary embodiments, a first cap portion contour creates a mechanical interlock that resists rotation of the cork relative to the cap. In other exemplary embodiments, a first cap portion contour creates a mechanical interlock that resists separation of the cork and the cap and rotation of the cork relative to the cap.

BRIEF DESCRIPTION OF THE DRAWINGS

Referring now to the drawings, wherein like elements are numbered alike in the following FIGURES.

DETAILED DESCRIPTION

As was noted above, the present disclosure relates to a stopper, comprising a cork portion that is bonded to a cap portion via an interlocking interface.

Figure 1:
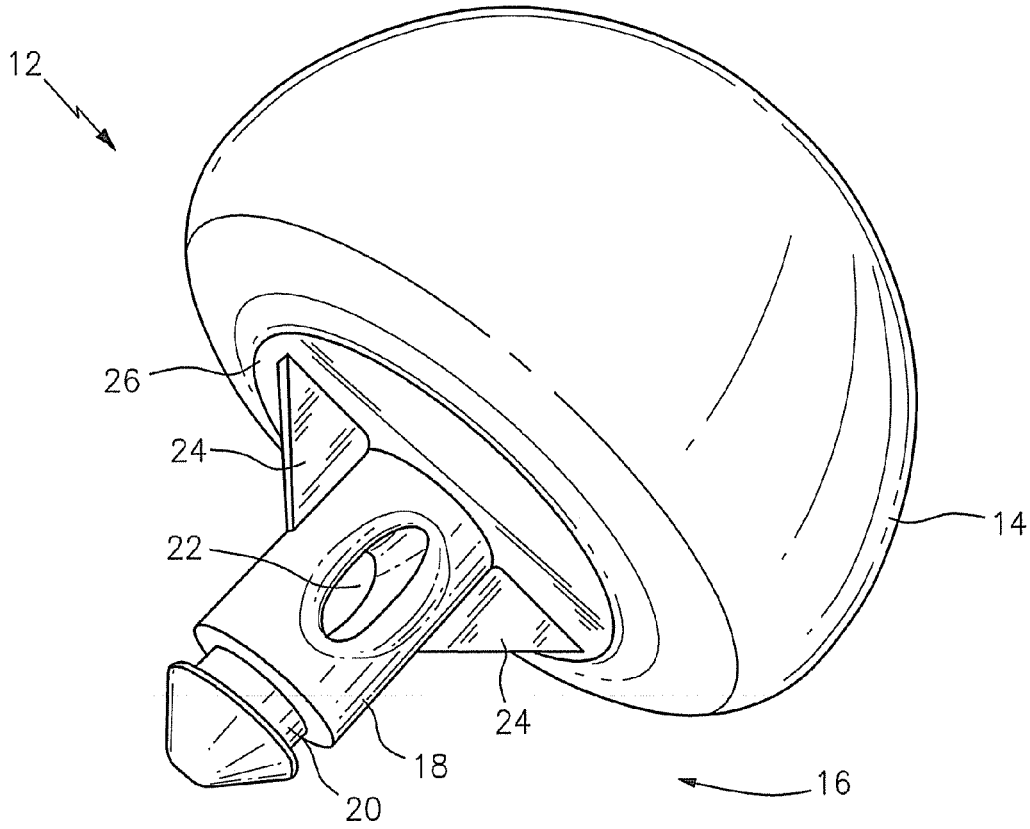
FIG. 1 is perspective view of an exemplary cap.
Figure 2:
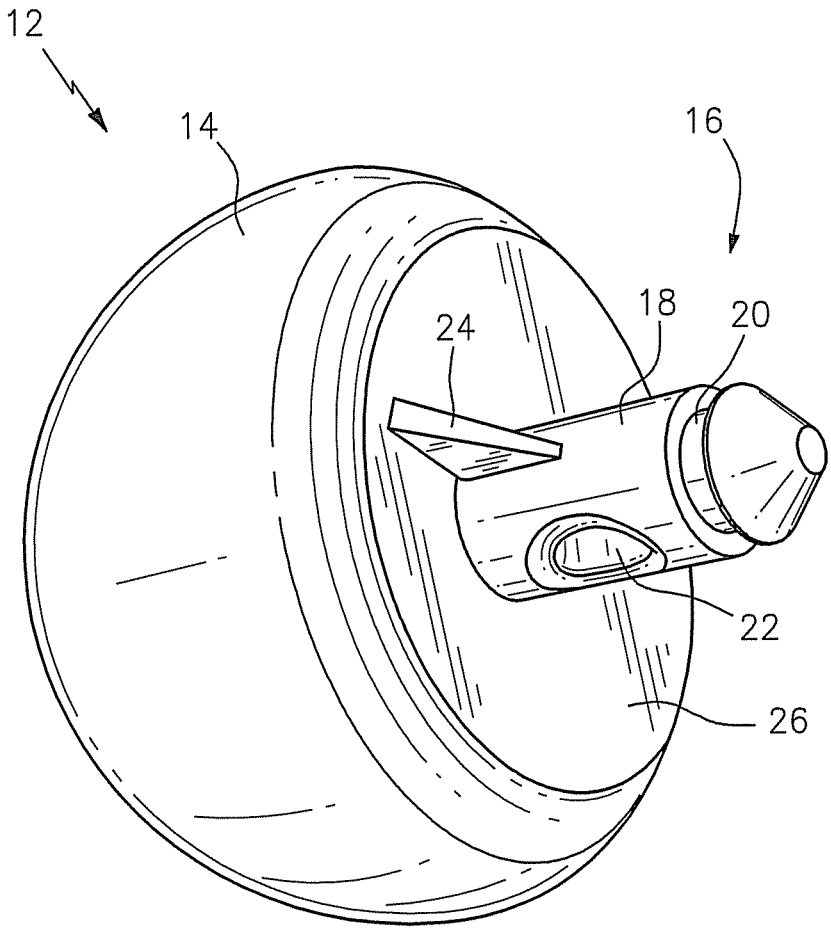
FIG. 2 is a side elevation view of the exemplary cap of FIG. 1.

Referring now to FIGS. 1 and 2, an exemplary cap is shown generally at 12. The cap includes a handle portion 14 and a cork interface portion, shown generally at 16. As is illustrated in FIGS. 1 and 2, the cork interface portion includes at least one contour that provides more surface area for the cork to cap bond. The illustrated exemplary cork interface portion includes a pin contour 18, a groove contour 20 on the pin contour 18, a hole contour 22 within the pin contour 18, and a first and a second fin contour 24 between the pin contour 18 and the otherwise bottom flat surface 26 of the handle portion 14.

Figure 3:
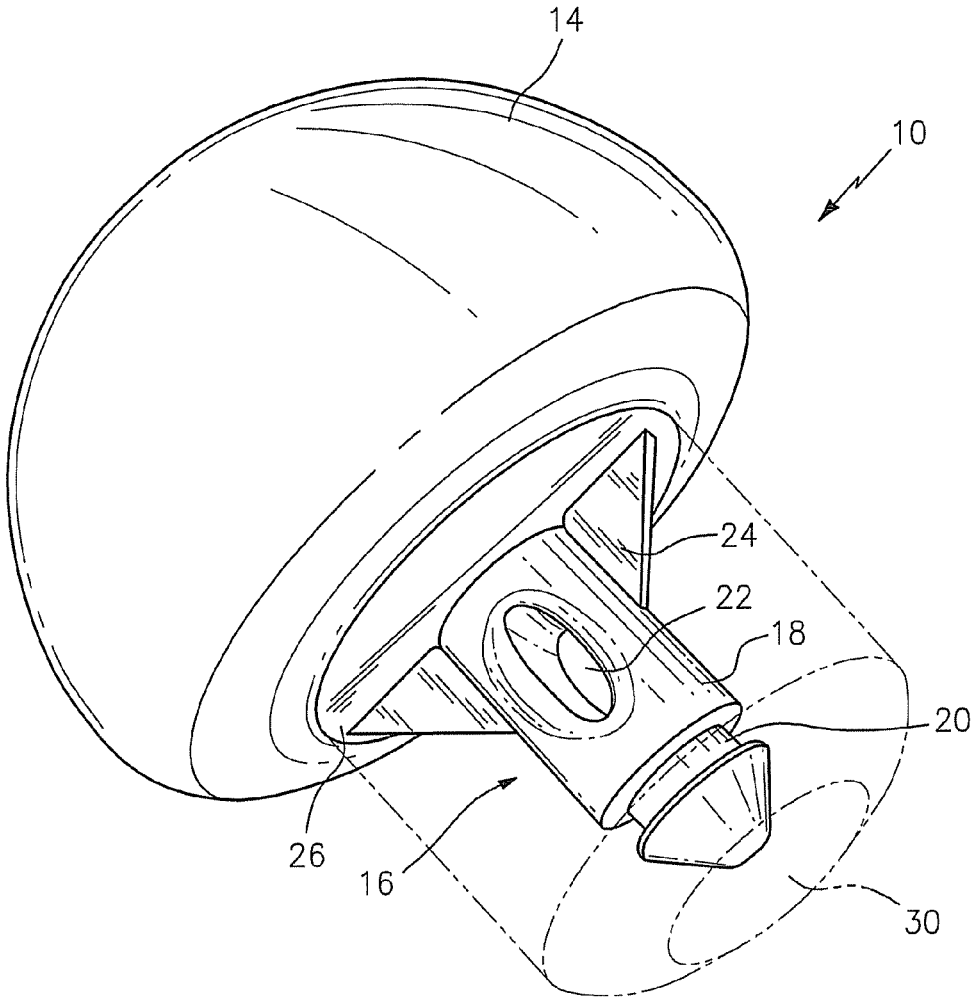
FIG. 3 is a perspective view of an exemplary stopper.
Figure 4:
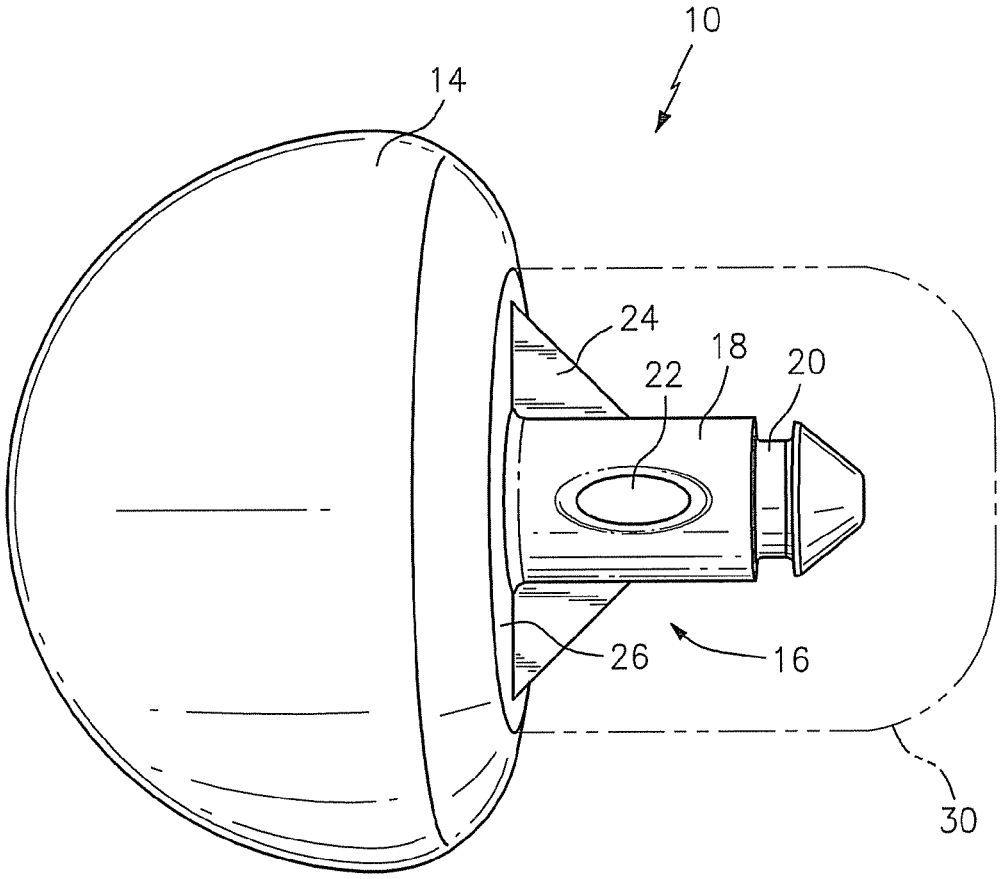
FIG. 4 is a side elevation view of the exemplary stopper of FIG. 3.

Referring now to FIGS. 3 and 4, an exemplary stopper is illustrated generally at 10. The exemplary stopper includes the exemplary elements of FIGS. 3 and 4 with a cork material 30 bonded thereto. In an exemplary embodiment, the cork material is a synthetic cork material. In another exemplary embodiment, the cork material is injection molded over the cork interface portion. In another exemplary embodiment, the cap and cork material are co-injected during assembly. In molding certain contours of the cap portion (e.g., grooves, holes or fins), sliders may be used in the mold to release such contours.

In another exemplary embodiment, a first cap portion contour creates a mechanical interlock that resists relative movement of the cork and the cap in a first direction. It is noted that each of the described contours resists relative movement of the cork and the cap in at least one direction. For example, the pin contour 18 resists bending of the cork material 30 off of its longitudinal axis. The groove 20 contour resists pulling of the cork 30 away from the bottom 26 of the cap 12. The hole contour 22 resists both pulling of the cork 30 away from the bottom 26 of the cap 12 and rotation of the cork 30 about the pin contour 18. The fin contour(s) 24 resist rotation of the cork 30 about the pin contour 18. Thus, various cap portion contours create a mechanical interlock that resist relative movement of the cork and the cap in at least one direction.

It will be apparent to those skilled in the art that, while exemplary embodiments have been shown and described, various modifications and variations can be made to the synthetic cork and method of making disclosed herein without departing from the spirit or scope of the invention. For example, recitations of contours, including projections and recesses, are non-limiting. The cap interface portion may include a single or a combination of contours providing a mechanical interlock. Additionally, various amounts of cork (e.g., widths) may be used such that the cork covers only a portion or, e.g., all of the bottom surface of the cap handle. Accordingly, it is to be understood that the various embodiments have been described by way of illustration and not limitation.

What is claimed is:

1. A stopper, comprising:

a cap, including a handle portion, a bottom portion and at least one contour dependent from said bottom portion, the contour providing increased surface area relative to said bottom portion; and a cork portion that is bonded to a cap portion via an interlocking interface provided by said contour, the interlocking interface resisting relative movement of the assembled cap and cork in at least one direction, wherein said contour is a hole provided through a side portion of a pin, said cork portion extends into the hole, and wherein the hole is configured to resist rotation and separation of cork material bonded to the surface of the pin adjacent to the hole.

2. A stopper in accordance with claim 1, further comprising, a second cap portion contour configured to create a second mechanical interlock that resists relative movement of the cork and the cap in a at least one direction.

3. A stopper in accordance with claim 2, wherein said second cap portion contour resists separation of the cork and the cap.

4. A stopper in accordance with claim 2, wherein said second cap portion contour resists rotation of the cork relative to the cap.

5. A stopper in accordance with claim 2, wherein said second cap contour a groove and wherein a third cap contour is a fin.

6. A stopper in accordance with claim 1, wherein said cork material is a synthetic cork material.

7. A method of manufacturing a stopper, comprising:

injection molding a cap, including a handle portion, a bottom portion and at least contour dependent from said bottom portion, the contour providing increased surface area relative to said bottom portion; and injection molding a cork portion around said a cork interface portion of said cap to bond said cork to the cap portion via an interlocking interface provided by said contour, the interlocking interface resisting relative movement of the assembled cap and cork in at least one direction, wherein said contour is a hole provided through a side portion of a pin, said cork portion extends into the hole, and wherein the hole is configured to resist rotation and separation of cork material bonded to the surface of the pin adjacent to the hole.

* * * * *